US007828049B2

(12) United States Patent
Yamamoto et al.

(10) Patent No.: US 7,828,049 B2
(45) Date of Patent: Nov. 9, 2010

(54) HEAT EXCHANGER

(75) Inventors: Koichi Yamamoto, Anjo (JP); Ryouichi Sanada, Obu (JP); Junji Kato, Kariya (JP)

(73) Assignee: Denso Corporation, Kariya (JP)

( * ) Notice: Subject to any disclaimer, the term of this patent is extended or adjusted under 35 U.S.C. 154(b) by 944 days.

(21) Appl. No.: 11/641,420

(22) Filed: Dec. 19, 2006

(65) Prior Publication Data

US 2007/0137839 A1 Jun. 21, 2007

(30) Foreign Application Priority Data

Dec. 20, 2005 (JP) ..... 2005-366270

(51) Int. Cl.
*F28D 7/10* (2006.01)

(52) U.S. Cl. ..... 165/140; 165/172; 165/174

(58) Field of Classification Search ..... 165/140, 165/148, 149, 150, 173, 175, 176
See application file for complete search history.

(56) References Cited

U.S. PATENT DOCUMENTS 6,328,098 B1 * 12/2001 Kodumudi et al. ..... 165/149
6,736,193 B2 * 5/2004 Kodumudi et al. ..... 165/149
6,793,012 B2 9/2004 Fang et al.
2003/0159816 A1 8/2003 Kodumudi et al.

FOREIGN PATENT DOCUMENTS

JP 2004 239598 8/2004

* cited by examiner

*Primary Examiner*—Ljiljana (Lil) V Ciric
(74) *Attorney, Agent, or Firm*—Harness, Dickey & Pierce, PLC

(57) ABSTRACT

A heat exchanger includes left and right header tanks disposed in parallel; top and bottom side plates that couple respectively both ends of the pair of the header tanks; a first plurality of tubes connected between the pair of the header tanks at both ends that are disposed in a region nearer the bottom side plate as a condenser; and a second plurality of tubes that are disposed in a region nearer the top side plate as an oil cooler. Each tube in the second tubes has a cross-sectional shape identical to that of each tube in the first tubes and the top side plate is formed to have a squared U-shaped cross section so that a return pipe communicating with the second tubes can be disposed along a groove having the squared U-shaped cross section of the top side plate.

4 Claims, 5 Drawing Sheets

HEAT EXCHANGER

BACKGROUND OF THE INVENTION

1. Field of the Invention

The present invention relates to a heat exchanger in which a condenser and an oil cooler are provided in parallel between a pair of headers.

2. Description of the Related Art

Conventionally, there is known a-heat exchanger in which a condenser and an oil cooler are integrated, for example, as shown in FIG. 4. The heat exchanger shown in FIG. 4 is disclosed in U.S. Pat. No. 6,793,012 and it has a pair of a first header 13 and a second header 15 that are disposed in parallel and oppositely and, between the pair of the headers 13 and 15, there are provided; a first tube group 17 that is comprised of six tubes and that is used as a condenser; and a second tube group 19 disposed above the first tube group 17 that is comprised of two tubes and that is used as an oil cooler. The first tube group 17 has: three forward tubes 17*a* through which a refrigerant flows from the first header 13 to the second header 15; and three backward tubes 17*b* through which the refrigerant flows from the second header 15 to the first header 13. Thus, the refrigerant injected through a refrigerant inlet 21 provided in the first header 13 travels through the forward tubes 17*a* to flow into the second header 15, and then travels through the backward tubes 17*b* to be discharged from a refrigerant outlet 23 provided in the first header 21. On the other hand, the second tube group 19 has: a forward tube 19*a* through which an oil passes from the second header 15 to the first header 13; and a backward tube 19*b* through which the oil passes from the first header 13 to the second header 15. Thus, the oil injected through an oil inlet 25 provided in the second header travels through the forward tube 19*a* to flow into the first header 13, and then travels through the backward tube 19*b* to be discharged from a discharge port 27 provided in the second header 15.

In such heat exchanger 11, the first tube group 17 and the second tube group 19 have different uses, and therefore the flow rate, flow speed, pressure and the like of the passing medium differ between the first and second tube groups 17 and 19. Therefore, the first and second tube groups 17 and 19 have different tube diameters, wall thicknesses and the like and, as a result, tubes of two types have to be prepared. Further, correspondingly, tube holes of two types have to be formed in the headers, and therefore there is a problem in that more man-hours are required and the cost is increased.

Further, the first and second tube groups 17 and 19 have tube holes of different pitches, and therefore two sets of jigs have to be prepared so as to form the tube holes and insert the tubes into the tube holes and, as a result, there is a problem here also in that the cost is increased.

On the other hand, Japanese Unexamined Patent Publication No. 2004-239598 discloses a heat exchanger 33 that is provided with a return pipe 31 disposed above the second tube group as shown in FIG. 5A. However, in the typical heat exchanger, a core 35 comprised of the tubes and fins has to be compressed before brazing the tubes and, for that purpose, a wire W is wound around the core 35 as shown in FIGS. 5A and 5B. At this time, there is a problem in that corners of the return pipe 31 may be crushed, as shown in FIG. 5B, if the winding force is too large.

SUMMARY OF THE INVENTION

It is an object of the present invention to solve the above problems and to provide a heat exchanger that can be manufactured easily with low cost and that can prevent a return pipe form being crushed.

In order to achieve the above object, there may be adopted means in which second tubes has a cross-sectional shape identical to that of first tubes and a second side plate has a base portion disposed in parallel to the second tubes, and opposing side walls depending from the base portion, and a return pipe is disposed between the side walls.

According to this means, even if the flow rate and pressure of a refrigerant passing through a condenser section are different from those of oil passing through an oil cooler section, the second tubes can use identical parts to those of the first tubes. Therefore, the number of the parts and, thus, the cost can be reduced. Further, tube insertion holes for both the first tubes and the second tubes, which have to be formed in left and right header tanks, can have an identical shape. Therefore, identical tools and jigs can be used and, as a result, the manufacturing cost can be reduced. Moreover, the first tubes and the second tubes may have the same pitch between the tubes so that the manufacturing process can be shortened, which can contribute to further cost reduction.

Further, in order to achieve the Above object, there may be adopted means in which a vent section is provided in a center region of the return pipe. Therefore, a difference in expansion between the return pipe and the second tube group can be absorbed.

Still further, in order to achieve the above object, there may be adopted means in which said first medium is a refrigerant and said second medium is oil. Therefore, the present invention is effective for any heat exchanger having a condenser section and an oil cooler section.

Still further, in order to achieve the above object, there may be adopted means in which a cross-sectional area of the return pipe is larger than that of second tubes.

DESCRIPTION OF THE PREFERRED EMBODIMENTS

Hereinafter, embodiments of the present invention will be described with reference to FIGS. 1-3.

Figure 1:
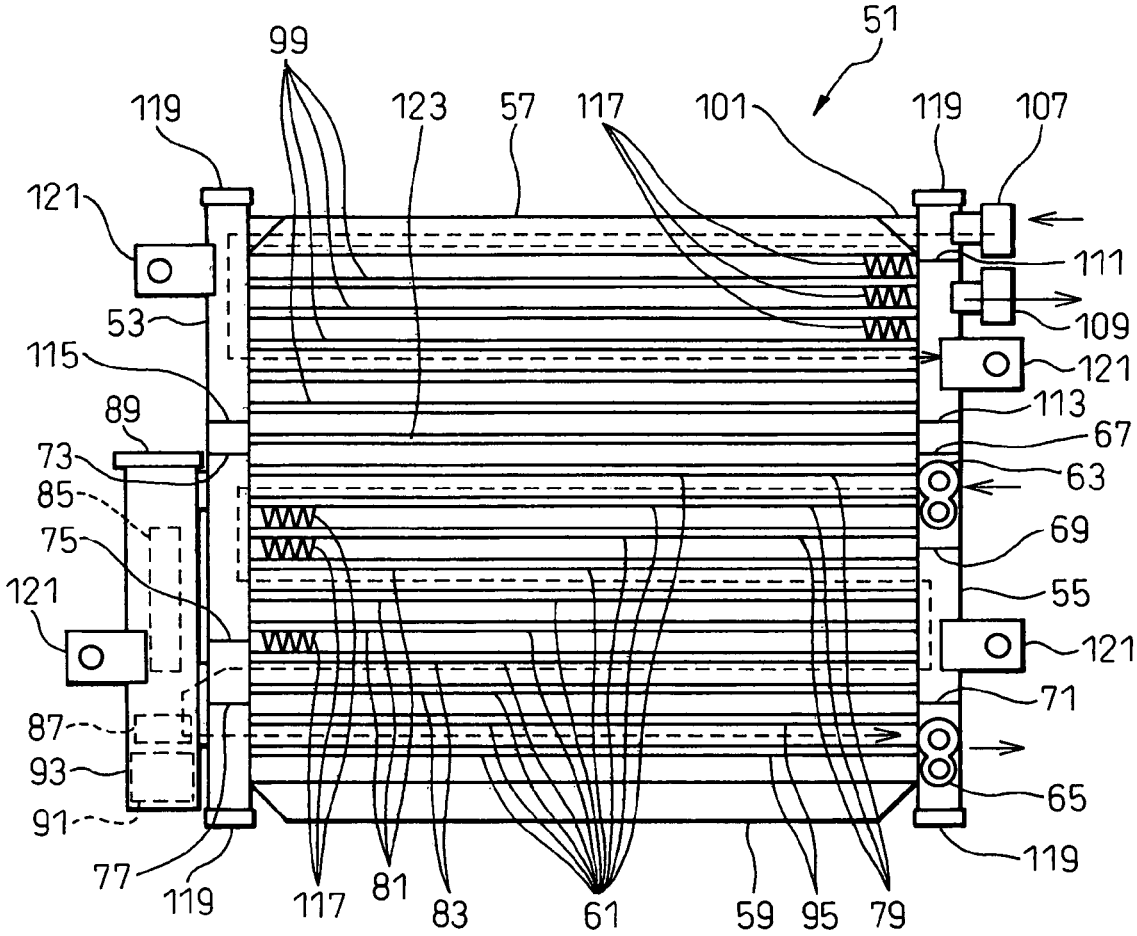
FIG. 1 is a front elevational view of a heat exchanger that is an embodiment of the present invention.
Figure 2A:
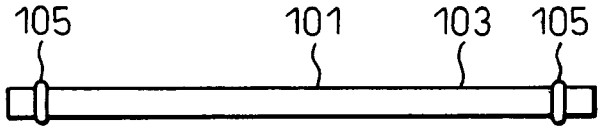
FIG. 2A is a elevational view showing a return pipe of the heat exchanger shown in FIG. 1.

FIG. 1 is a diagram showing a first embodiment of the present invention. In this figure, reference numeral 51 designates a heat exchanger. The heat exchanger 51 has a symmetrical pair or a left header tank 53 and a right header tank 55 that are disposed in parallel and oppositely. Top and bottom ends of the pair of header tanks 53 and 55 disposed in parallel are provided with a symmetrical pair of a top side plate 57 and a bottom side plate 59, respectively, to couple header tanks 53 and 55 with each other. The top and bottom side plates 57 and 59 are formed to have a squared U-shaped cross section and, along with the left and right header tanks 53 and 55, constitute a structural framework of the heat exchanger 51. The side plate 57 has a base portion 57*a* and opposing side walls 57*b* extending from both sides of the base portion 57*a*.

In a region somewhat near the bottom side plate 59, a first tubes 61 constituting a condenser section is connected between the left header tank 53 and the right header tank 55. The first tubes 61 include 10 tubes disposed in parallel horizontally and both ends of each tube are fitted and joined to respective tube holes (not shown) formed in the left and right header tanks 53 and 55.

A refrigerant inlet 63 and a refrigerant cutlet 65 are provided at the top and bottom, respectively, of the right header tank 55, with which the first tubes 61 is connected. Further, separators 67, 69 and 71 are provided in the right header tank 55 and separators 73, 75 and 77 are provided in the left header tank 53, so that a refrigerant entering through the refrigerant inlet 63 can travel twice in a round-trip manner between the left and right header tanks 53 and 55 and exit through the refrigerant outlet 65.

More specifically, the refrigerant enters through the refrigerant inlet 65 into a space between the separator 67 and the separator 69 of the right header tank 55. The refrigerant travels through a first forward tube 79 that is disposed at an upper side among the first tubes 61, turns around in a space delimited by the separator 73 and the separator 75 in the left header tank 53 and enters into a first backward tube 81 that is disposed below the first forward tube 79. The refrigerant turns around in a space delimited by the separator 69 and the separator 71 in the right header tank 55, enters into two second forward tubes 83 that are dispose below the first backward tube 81, and then enters into a space delimited by the separator 75 and the separator 77 in the left header tank 53. This space is connected to a modulator 93 that accommodates a desiccant 85 and a filter 87 and is provided with a modulator cap 89 at one end and a cap 91 for detaching the filter and the desiccant at the other end. The refrigerant passes through this modulator 93, and then enters into a space below the separator 77 in the left header tank 53, travels through a second backward tube 95 connected thereto, and enters into a space below the separator 71 in the right header tank 55 to be discharged from the refrigerant outlet 97. When the refrigerant passes through the first tubes 61, it is cooled and liquefied.

In a region somewhat near the top side plate 57, a second tubes 99 constituting an oil cooler section is connected between the left header tank 53 and the right header tank 55. The second tubes 99 consists of five tubes, each of which is formed into a shape similar to that of the first tubes 61, and both ends of each tube are fitted and joined to respective tube holes (not shown) formed in the left and right header tanks 53 and 55.

Further, a return pipe 101 is disposed in a groove having a square U-shaped cross section in the top side plate 57. The return pipe 101 has a diameter larger than that of the tubes in the second tubes 99 mentioned above and its cross-sectional area where the fluid flows is substantially equal to the total of that of all tubes in the second tubes 99. Still further, as shown in FIG. 2A, the return pipe 101 is provided with flange sections 105 formed at both ends of a straight pipe section 103. Both ends of the return pipe 101 are fitted and joined to respective tube holes (not shown) formed in the left and right header tanks 53 and 55.

An oil inlet 107 and an oil outlet 109 are provided at the top of the right header tank 55, with which the second tubes 99 is connected. Further, separators 111 and 113 are provided in the right header tank 55 and a separator 115 is provided in the left header tank 53, so that oil entering through the oil inlet 107 can travel in a round-trip manner between the left and right header tanks 53 and 55 end exit through the oil outlet 109.

More specifically, the oil entering through the oil inlet 107 enters into a space above the separator 111 of the right header tank 55, and then travels through the return pipe 101 and enters into a space above the separator 115 of the left header tank 53. The oil is cooled when it travels through the second tubes 99, and then enters into a space between the separators 111 and 113 of the right header tank 55 to be discharged from the oil outlet 109.

Here, it should be noted that reference numeral 117 designates fins that are formed between the respective tubes. Further, header caps 119 are provided at the top and bottom ends of the left and right header tanks 53 and 55 and four attachment brackets 121 are provided in the left and right header tanks 53 and 55 and the modulator 93. Still further, in a region between the left and right header tanks 53 and 55, a dummy tube 123 is provided between the first tubes 61 and the second tubes 99.

As described above, in the heat exchanger 51 that has; the pair of the left header tank 53 and the right header tank 55; the pair of the top side plate 57 and the bottom side plate 59 that couples the both ends of the left and right header tanks 53 and 55 with each other; the first tubes 61 that are provided in the region somewhat nearer the bottom side plate 59 between the header tanks 53 and 55 and that is used as the condenser section; and the second tubes 99 that are provided in the region somewhat nearer the top side plate 57 between the header tanks 53 and 55 and that is used as the oil cooler, wherein each tube in the second tubes 59 has a cross-sectional shape identical to that of each tube in the first tubes 61 and the top side plate 5, that is disposed outside this second tubes 99 is formed to have the squared U-shaped cross section so that the return pipe 101 communicating with the second tubes 99 can be disposed along the groove having the squared U-shaped cross section of this top side plate 57, even if the flow rate and the pressure of the refrigerant passing through the condenser section are different from those of the oil passing through the oil cooler section, the second tubes 99 can use identical parts to those of the first tubes 61. Therefore, the number of the parts and, thus, the cost can be reduced. In particular, in the conventional heat exchanger, when the oil inlet and outlet are disposed in the same header tank, the oil cooler section has to use tubes different from those of the condenser section, and therefore the cost is increased. In contrast, in the heat exchanger 51, the oil cooler section and the condenser section can use the identical tubes, and therefore the cost can be reduced significantly.

Further, the tube insertion holes for both the first tubes 61 and the second tubes 99, which have to be formed in the left and right header tanks 53 and 55, can have an identical shape. Therefore, identical tools and jigs can be used and, as a result, the manufacturing cost can be reduced. Moreover, the first tubes and the second tubes may have the same pitch between the tubes so that the manufacturing process can be shortened, which can contribute to further cost reduction.

Figure 2B:
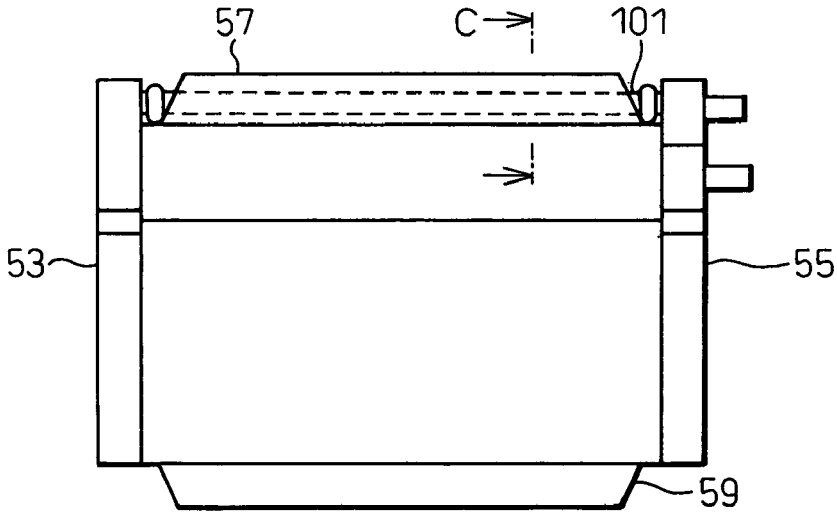
FIG. 2B is a schematic elevational view showing a side plate to which a return pipe of the heat exchanger shown in FIG. 1 is attached.
Figure 2C:
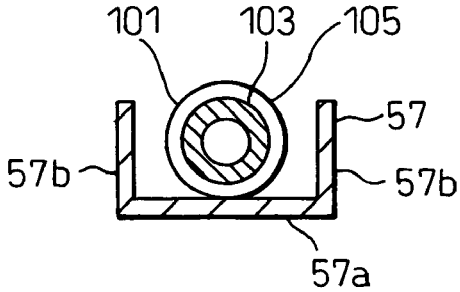
FIG. 2C is a cross-sectional view taken along the line C-C in FIG. 2B.
Figure 2D:
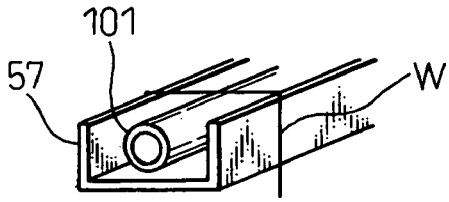
FIG. 2D is a perspective view showing a state in which a wire is wound around a side plate.
Figure 3:
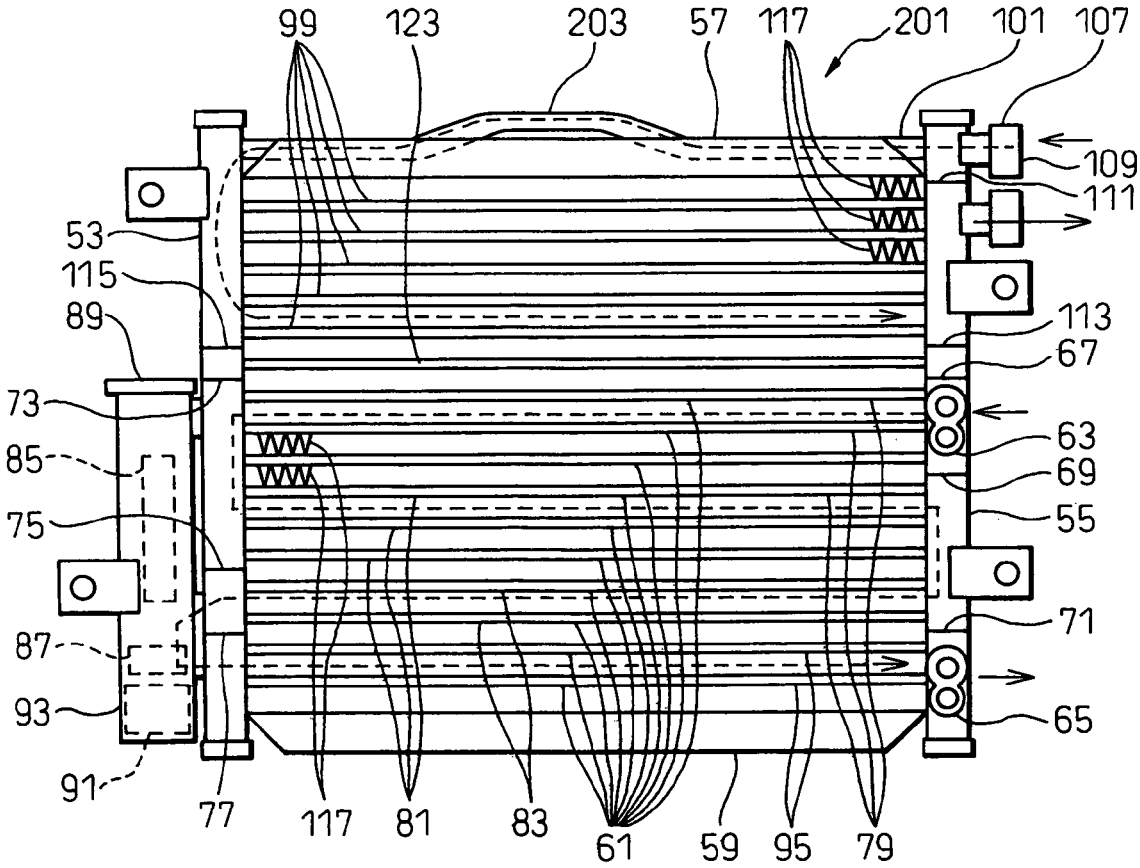
FIG. 3 is a front elevational view showing a case in which a return pipe is provided with a vent section in the heat exchanger shown in FIG. 1.
Figure 4:
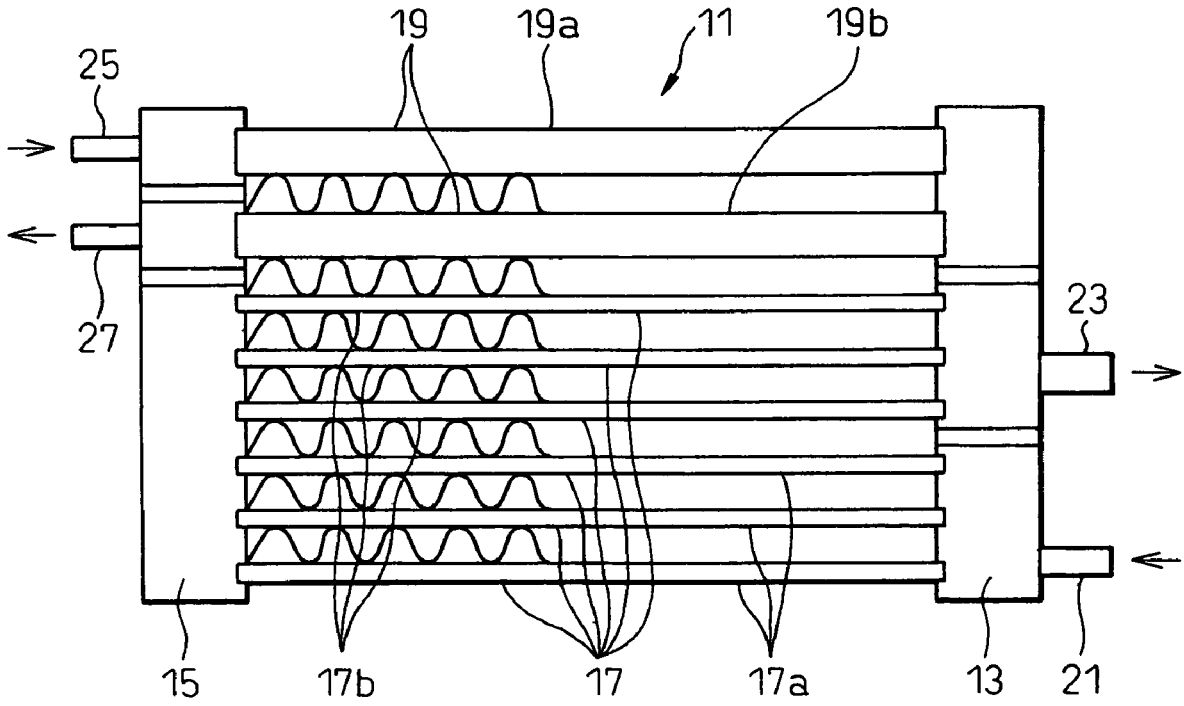
FIG. 4 is a front elevational view showing a conventional heat exchanger.
Figure 5A:
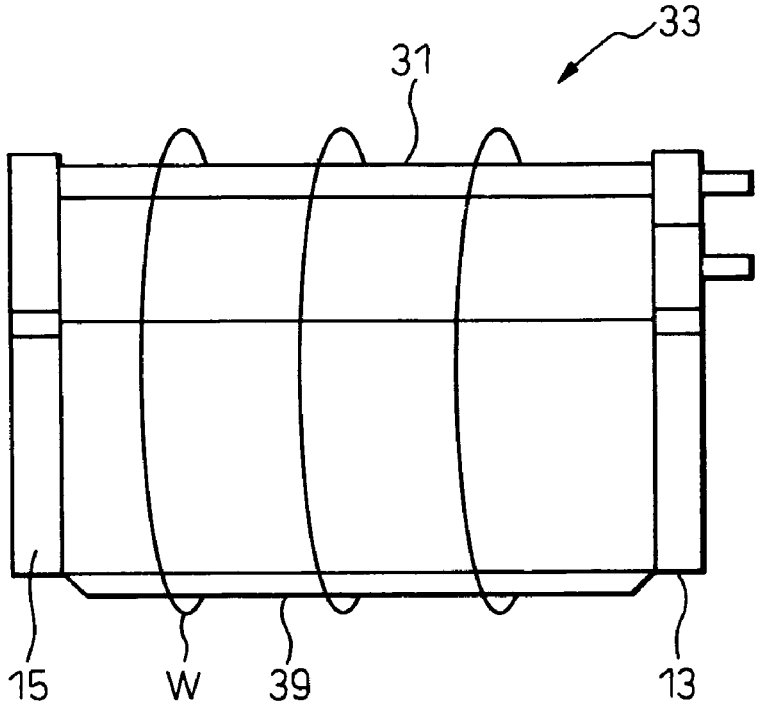
FIG. 5A is a front elevational view showing a state in which a wire is wound around a core in a conventional heat exchanger.
Figure 5B:
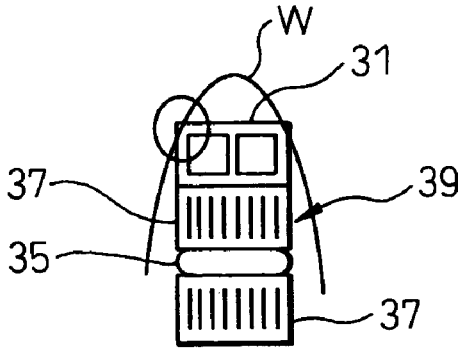
FIG. 5B is a cross-sectional view showing a relationship between a return pipe and a wire in a state in which the wire is wound around a core in a conventional heat exchanger.

Still further, as shown in FIGS. 2B and 2C, the return pipe 101 is disposed along the groove of the side plate 57 having the squared U-shaped cross section, and therefore even if a wire W is wound around a core for compressing the tubes and the fins before brazing as shown in FIG. 2D, the wire W does not make contact with the return pipe 101 and corners of the return pipe 101 are prevented from being crushed.

Next, a second embodiment of the present invention will be described with reference to FIG. 3.

The heat exchanger 201 shown in this figure is similar to the heat exchanger 51 shown in FIG. 1, except that a vent section 203 is provided in a center region of the return pipe 101 of the heat exchanger 51. In consideration that the material, the cross-sectional shape and the like of the first and second tubes 61 and 99 are different from those of the return pipe 101 and, therefore, there is a difference in expansion between them, the vent section 203 is provided so as to absorb the difference in expansion.

As described above, in this second embodiment, in which the vent section 203 is provided in the return pipe 101, the difference in expansion between the return pipe and the tube groups can be absorbed. Therefore, unwanted stress and distortion can be prevented from being applied to the cooler and, as a result, the cooler can have a long life and high reliability.

Though the heat exchanger having the condenser section and the oil cooler section has been described in the above embodiments, the present invention is not limited to this application and can be applied to any apparatus that cools two fluids having different characteristics such as pressure, flow rate and the like at the same time.

Further, though a side plate having a squared U-shaped cross section is adopted in the above embodiments, the present invention is not limited to this configuration and the side plate may have any concave cross section such as U-shaped, C-shaped and the like.

What is claimed is:

1. A heat exchanger comprising:

a pair of headers disposed in parallel and oppositely, a first side plate connecting first ends of said pair of headers, a second side plate connecting second ends of said pair headers, said second side plate disposed in parallel to said first side plate, a plurality of parallel first tubes communicating with said pair of headers, said first tubes adapted to have a first medium flowing therethrough, a plurality of parallel second tubes communicating with said pair of headers, said plurality of second tubes being disposed in a region nearer said second side plate, said second tubes having a cross-sectional shape identical to that of said first tubes, said second tubes adapted to have a second medium flowing therethrough, and a return pipe communicating with said second tubes through one of said headers;

wherein said second side plate has a base portion disposed in parallel to said second tubes, and opposing side walls depending from said base portion, and said return pipe being disposed between said side walls.

2. The heat exchanger according to claim 1, wherein a vent section is formed in a center region of said return pipe.

3. The heat exchanger according to claim 1, wherein said first medium is a refrigerant and said second medium is an oil.

4. The heat exchanger according to claim 1, wherein the cross-sectional area of said return pipe is larger than that of the second tube.

* * * * *